US006871688B2

(12) United States Patent
Yamazaki et al.

(10) Patent No.: US 6,871,688 B2
(45) Date of Patent: Mar. 29, 2005

(54) APPARATUS AND METHOD FOR MANUFACTURING DIE-CAST PRODUCT

(75) Inventors: Kenji Yamazaki, Nishio (JP); Masanari Terui, Gamagori (JP); Koji Nishikawa, Okazaki (JP)

(73) Assignee: Denso Corporation, Kariya (JP)

( * ) Notice: Subject to any disclaimer, the term of this patent is extended or adjusted under 35 U.S.C. 154(b) by 53 days.

(21) Appl. No.: 10/654,467

(22) Filed: Sep. 4, 2003

(65) Prior Publication Data

US 2004/0061250 A1 Apr. 1, 2004

(30) Foreign Application Priority Data

Sep. 30, 2002 (JP) ..... 2002-286327

(51) Int. Cl.[7] ..... B22D 29/00

(52) U.S. Cl. ..... 164/132; 164/137; 164/452; 249/64; 249/151

(58) Field of Search ..... 164/452, 113, 164/132, 137; 249/151, 64

(56) References Cited

U.S. PATENT DOCUMENTS 4,919,189 A * 4/1990 Sato et al. ..... 164/137
4,958,676 A * 9/1990 Kuntz ..... 164/340
6,460,601 B1 * 10/2002 Brehm ..... 164/132
6,681,835 B2 * 1/2004 Maeyama et al. ..... 164/113

* cited by examiner

*Primary Examiner*—Kiley S. Stoner
*Assistant Examiner*—Len Tran
(74) *Attorney, Agent, or Firm*—Nixon & Vanderhye P.C.

(57) ABSTRACT

Fluid pressure of a first fluid chamber of a driving means, which acts as a back pressure, is monitored by a monitoring means when a core pin is driven by the driving means in an inserting direction before injection of a molten material into a cavity of a die arrangement. When the monitored fluid pressure of the first fluid chamber exhibits abnormal behavior that is different from normal behavior observed during a normal period, the monitoring means controls the driving means to stop the driving of the core pin in the inserting direction.

7 Claims, 7 Drawing Sheets

APPARATUS AND METHOD FOR MANUFACTURING DIE-CAST PRODUCT

CROSS REFERENCE TO RELATED APPLICATION

This application is based on and incorporates herein by reference Japanese Patent Application No. 2002-286327 filed on Sep. 30, 2002.

BACKGROUND OF THE INVENTION

1. Field of the Invention

The present invention relates to an apparatus and a method for manufacturing a die-cast product.

2. Description of Related Art

Various die-cast products, which have a cast hole and are manufactured by die-casting, are previously known. For example, such a die-cast product can be produced as follows. First, a hydraulic cylinder is driven to insert a core pin in a die arrangement and thereby to place the core pin in a cavity of the die arrangement. Thereafter, a molten material is filled into the cavity to produce the die-cast product. Then, the hydraulic cylinder is driven to retract the core pin away from the cavity, and the die-cast product is removed from the die arrangement.

In the above case, when the core pin is inserted into the cavity, the core pin could collide with the die arrangement due to, for example, occurrence of a deviation of a central axis of the core pin. When the drive force is kept applied to the core pin to drive the core pin in the inserting direction upon the collision of the core pin with the die arrangement, the die arrangement can be damaged. Particularly, in a case where a plurality of cavity inserts, through which the core pin is inserted, is placed in the die arrangement along the central axis of the core pin, the core pin can be easily collide with the cavity inserts, causing a high incidence of damage of the cavity inserts which have a relatively low strength. Such damage of the die arrangement reduces the productivity of the die-cast product.

SUMMARY OF THE INVENTION

Thus, it is an objective of the present invention to provide an apparatus and a method for manufacturing a die-cast product in a manner that restrains a damage of a die arrangement in advance.

To achieve the objective of the present invention, there is provided an apparatus for manufacturing a die-cast product, which includes a cast hole. The apparatus includes a die arrangement, an injecting means, a core pin, a driving means and a monitoring means. The die arrangement defines a cavity therein. The injecting means is for injecting a molten material into the cavity. The core pin is reciprocable into and out of the cavity. The driving means is for reciprocably driving the core pin. The driving means includes a first fluid chamber and a second fluid chamber. The first fluid chamber applies fluid pressure to the core pin in a retracting direction of the core pin to move the core pin away from the cavity. The second fluid chamber applies fluid pressure to the core pin in an inserting direction of the core pin to move the core pin into the cavity. The driving means reciprocably drives the core pin by adjusting the fluid pressure of each of the first fluid chamber and the second fluid chamber. The monitoring means is for monitoring the fluid pressure of the first fluid chamber, which acts as a back pressure, when the core pin is driven by the driving means in the inserting direction before injection of the molten material from the injecting means into the cavity. When the monitored fluid pressure of the first fluid chamber exhibits abnormal behavior that is different from normal behavior observed during a normal period, the monitoring means controls the driving means to stop the driving of the core pin in the inserting direction.

Alternative to the above monitoring means, there may be provided a monitoring means for monitoring information that relates to at least one fluid pressure, which is applied to the core pin to drive the core pin. In such a case, when the information indicates occurrence of abnormal behavior of at least one of the at least one fluid pressure, which is different from normal behavior of the at least one of the at least one fluid pressure observed during a normal period, upon driving of the core pin by the driving means in the inserting direction, the monitoring means controls the driving means to stop the driving of the core pin in the inserting direction.

To achieve the objective of the present invention, there is also provided a method for manufacturing a die-cast product, which includes a cast hole. According to the method, a core pin is driven in an inserting direction until the core pin reaches an insertable limit position to insert the core pin into a cavity of a die arrangement by supplying working fluid into a second fluid chamber of a driving means while draining working fluid from a first fluid chamber of the driving means. A fluid pressure of the first fluid chamber, which acts as a back pressure, is monitored during the driving of the core pin in the inserting direction. Furthermore, the core pin is stopped when the monitored fluid pressure of the first fluid chamber exhibits abnormal behavior that is different from normal behavior exhibited in a normal operation. Then, a molten material is injected from an injecting means into the cavity. Thereafter, the molten material received in the cavity is solidified to form the die-cast product. Next, the core pin is driven in a retracting direction until the core pin reaches a retractable limit position to remove the core pin from the cavity. Then, the die-cast product is removed from the cavity.

BRIEF DESCRIPTION OF THE DRAWINGS

The invention, together with additional objects, features and advantages thereof, will be best understood from the following description, the appended claims and the accompanying drawings, where like numerals represent like components, in which:

DETAILED DESCRIPTION OF THE INVENTION

An embodiment of the present invention will be described with reference to the accompanying drawings.

Figure 1:
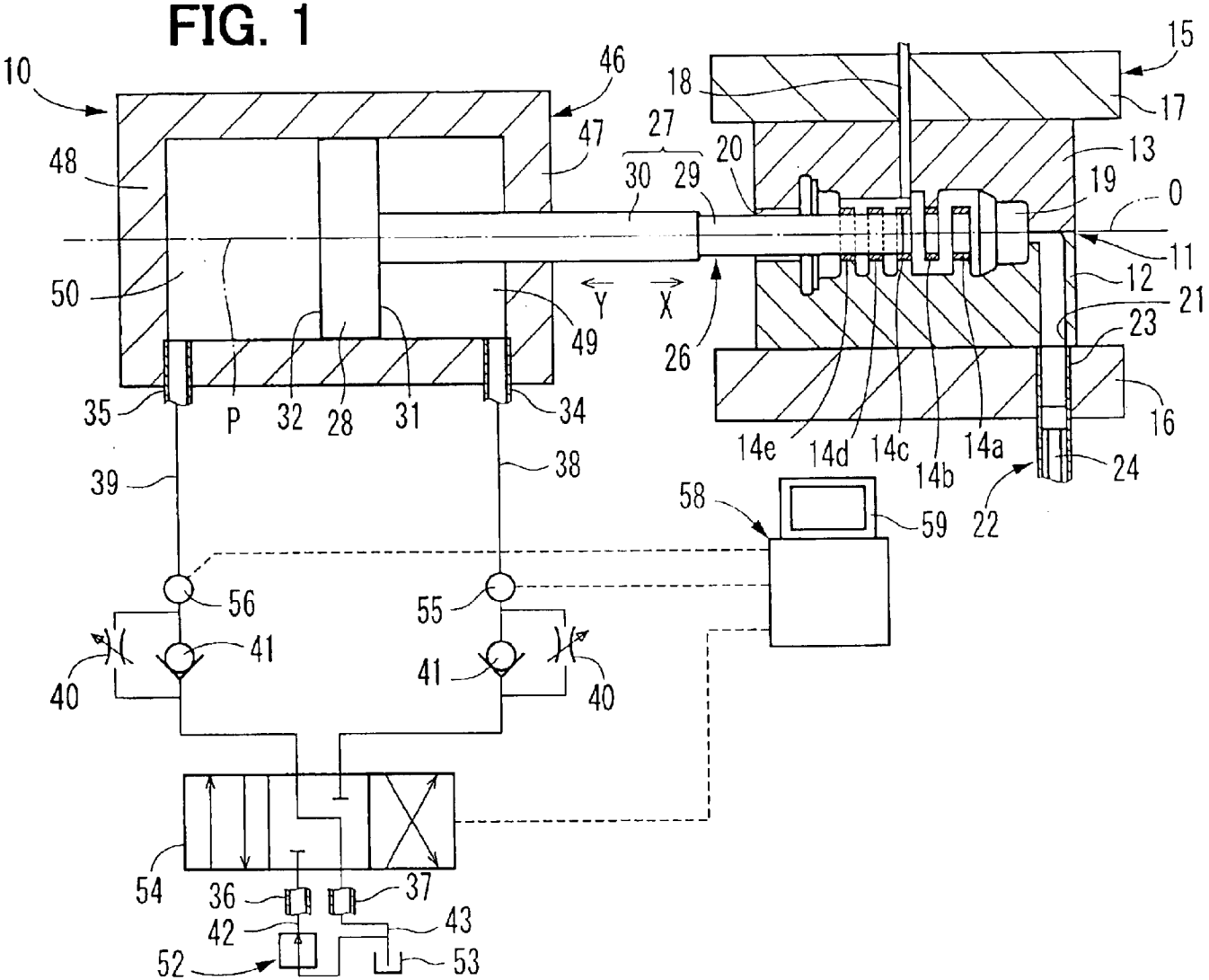
FIG. 1 is a schematic view showing a structure of a manufacturing apparatus according to an embodiment of the present invention.
Figure 2:
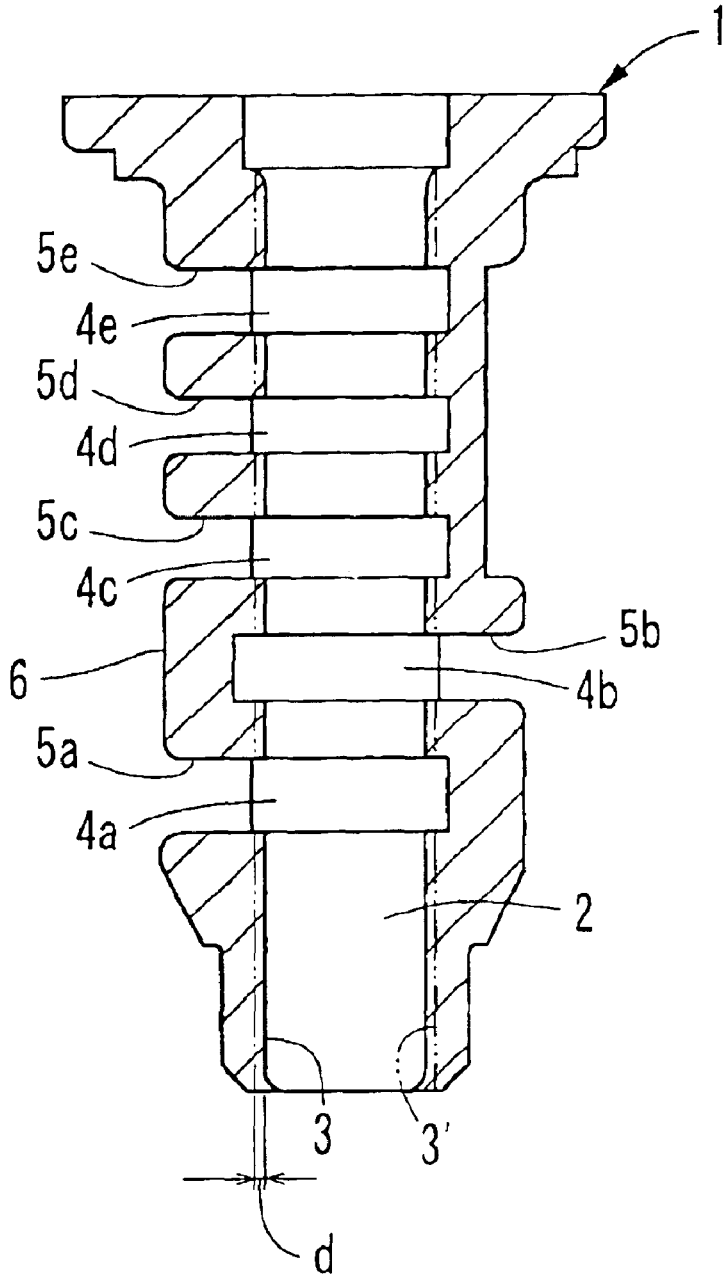
FIG. 2 is a longitudinal cross sectional view of a sleeve manufactured according to the embodiment of the present invention.

FIG. 1 shows a manufacturing apparatus for a die-cast product according to the embodiment of the present invention. The manufacturing apparatus 10 produces a sleeve 1 of a solenoid valve, such as one shown in FIG. 2, through die-casting. The sleeve 1, which serves as a die-cast product, is made, for example of aluminum alloy and is shaped into a generally cylindrical form that has a cast hole 2. A plurality of grooves 4*a*–4*e*, which are aligned in an axial direction, is provided in an inner peripheral wall surface 3 of the sleeve 1, which defines the cast hole 2. Furthermore, a plurality of through holes 5*a*–5*e*, which penetrate from a base of each corresponding one of the grooves 4*a*–4*e* to an outer peripheral wall surface 6 of the sleeve 1, is provided in the sleeve 1. In FIG. 2, dot-dot-dash lines indicate location of an inner peripheral wall surface 3', which is produced by the cutting operation performed after the die-casting operation in the manufacturing apparatus 10.

As shown in FIG. 1, the manufacturing apparatus 10 includes a die arrangement 11, a die closure arrangement 15, an injecting arrangement 22, a core pin 26, connecting pipe lines 34–37, a cylinder block 46, a hydraulic pump 52, a solenoid valve 54, pressure sensors 55, 56 and a control unit 58.

The die arrangement 11 includes a stationary die 12, a movable die 13 and a plurality of cavity inserts 14*a*–14*e*. The die closure arrangement 15, which opens and closes the die arrangement 11, has a die closure mechanism normally used in a general die-casting machine and includes a stationary platen 16, a movable platen 17 and an ejector pin 18.

The stationary die 12 and the movable die 13 are installed to the stationary platen 16 and the movable platen 17, respectively. When the movable platen 17 is driven by a drive device (not shown) of the die closure arrangement 15, the movable die 13 can be reciprocated to move toward and away from the stationary die 12. When the stationary die 12 and the movable die 13 are engaged with each other, a cavity 19 is defined between the stationary die 12 and the movable die 13. The cavity 19 has a circular lateral cross section and extends along a contact surface between the dies 12, 13 to correspond with an outer contour of the sleeve 1. A through hole 20, which extends along both the stationary die 12 and movable die 13, is communicated with one of two ends of the cavity 19, which are opposed along a central axis 0 of the cavity 19. The through hole 20 is coaxial with the cavity 19 and extends along the contact surface between the dies 12, 13 such that the through hole 20 has a circular cross section, which has a diameter larger than a minimum diameter of the cavity 19. A gate 21, which extends through the stationary die 12, is communicated with the other one of the ends of the cavity 19, which are opposed along the central axis 0 of the cavity 19. The ejector pin 18, which extends in the movable die 13 in a manner that allows movements of the ejector pin 18 into and out of the cavity 19, is used to eject the sleeve 1 after the die-casting.

Each of the cavity inserts 14*a*–14*e* is shaped into an identical annular plate form and has a plate thickness, which corresponds to a width of a corresponding groove 4*a*–4*e* of the sleeve 1. One cavity insert 14*b* is held by the movable die 13, and the rest of the cavity inserts 14*a*, 14*c*–14*e* are held by the stationary die 12. When the stationary die 12 and the movable die 13 are engaged with each other, each cavity insert 14*a*–14*e* is aligned within the cavity 19 along the central axis 0.

The injecting arrangement 22 has an injecting mechanism that is normally used in a die-casting machine of a cold chamber type. The injecting arrangement 22 includes a sleeve 23 and a plunger 24. The sleeve 23 is connected to the gate 21 and receives the plunger 24. The injecting arrangement 22 introduces a molten material, such as molten aluminum alloy, into the sleeve 23 and pressurizes the molten material by the plunger 24 to inject the molten material into the cavity 19. The injecting arrangement 22 serves as an injecting means.

The core pin 26 includes a rod 27 and a piston 28. The rod 27 is arranged in a manner that allows reciprocable movements of the rod 27 into and out of the cavity 19. The piston 28 receives hydraulic pressure.

Figure 3A:
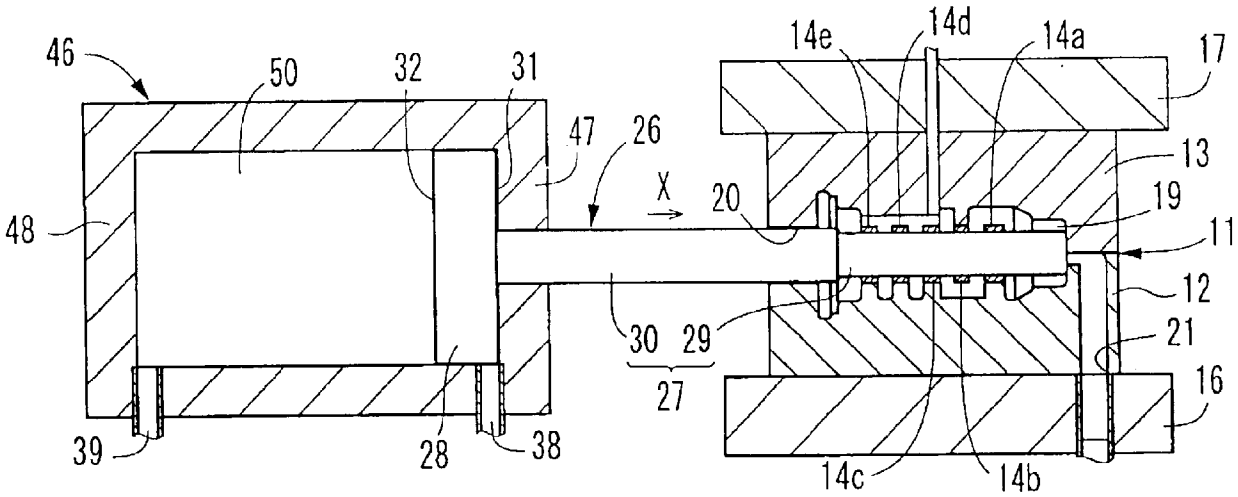
FIG. 3A is a schematic view showing one operational state of the manufacturing apparatus shown in FIG. 1.
Figure 3B:
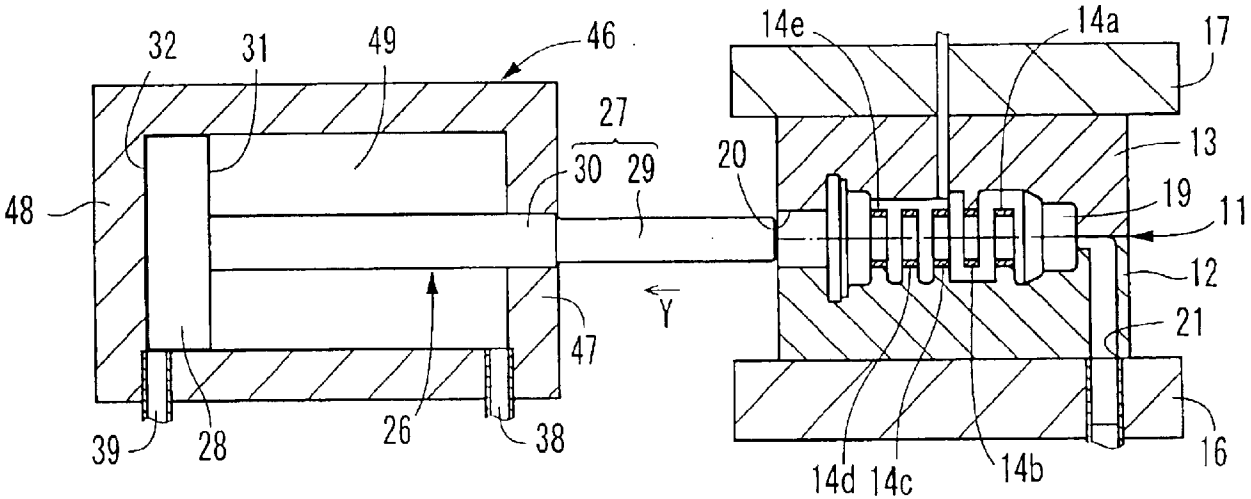
FIG. 3B is a schematic view showing another operational state of the manufacturing apparatus shown in FIG. 1.
Figure 4:
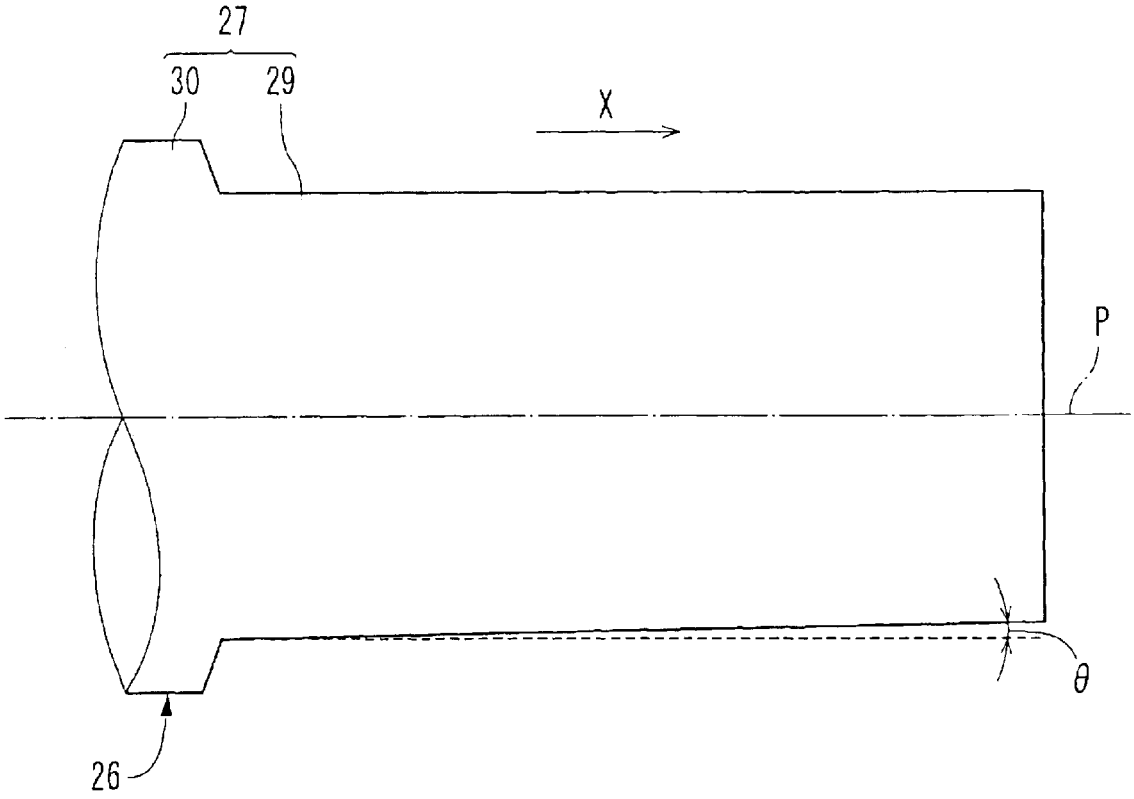
FIG. 4 is a schematic view showing a core pin of FIG. 1 in an enlarged scale.

The rod 27 is shaped into an elongated stepped cylindrical form and has a small diameter portion 29 and a large diameter portion 30 separated by a step. The rod 27 is arranged coaxially with the cavity 19 of the die arrangement 11 defined upon engagement of the dies 11, 12. The rod 27 is inserted into the cavity 19 through the through hole 20 of the die arrangement 11. In FIGS. 1, 3 and 4, "X" indicates an inserting direction of the rod 27 into the cavity 19. At an insertable limit position of the rod 27 in the cavity 19 shown in FIG. 3A, the small diameter portion 29 of the rod 27 extends through all of the cavity inserts 14*a*–14*e* of the die arrangement 11, and the large diameter portion 30 of the rod 27 closes the through hole 20 in an air-tight manner. Furthermore, when the rod 27 is moved from the insertable limit position in a retracting direction, which is away from the cavity 19 and is indicated by "Y" in FIGS. 1 and 3, the rod 27 is removed from the cavity inserts 14*a*–14*e* and the through hole 20.

As shown in FIG. 4 in an enlarged scale, the small diameter portion 29 of the rod 27 is tapered toward an inserting end side thereof and has a draft angle θ. Although the draft angle θ can be set to any appropriate value, the draft angle θ is set to be within a range of 0–30 degrees in the present embodiment. By adapting such a small draft angle θ, it is possible to reduce an amount "d" of cut (FIG. 2) at the time of finishing the original inner peripheral wall surface 3 after the die-casting of the sleeve 1. In this way, the finished inner peripheral wall surface 3' produced after the cutting is located in close proximity to the original inner peripheral wall surface 3 where less blowholes are present. Thus, it is possible to reduce the amount of blowholes exposed in the finished inner wall surface 3'.

The piston 28 is formed as an annular flange located in the large diameter portion side end of the rod 27. A surface of the piston 28, which is perpendicular to a central axis P of the rod 27 and faces in the inserting direction X, constitutes a first pressure receiving portion 31, and another surface of the piston 28, which is perpendicular to the central axis P of the rod 27 and faces in the retracting direction Y, constitutes a second pressure receiving portion 32.

The connecting pipe lines 34, 35 are connected to the cylinder block 46 and the solenoid valve 54 and form a first flow passage 38 and a second flow passage 39, respectively. A portion of each connecting pipe line 34, 35 is branched into two branched pipes, which receive a flow rate control valve 40 and a check valve 41, respectively. The flow rate control valve 40 adjusts a flow rate of working fluid, which flows in the corresponding flow passage 38, 39, to a predetermined value. The check valve 41 prevents flow of working fluid in the corresponding flow passage 38, 39 from the cylinder block 46 side to the solenoid valve 54 side.

The connecting pipe lines 36, 37 are connected to the solenoid valve 54 and the hydraulic pump 52 and form a third flow passage 42 and a fourth flow passage 43, respectively.

The cylinder block 46 cooperates with the piston 28 to form a reciprocable hydraulic cylinder, which reciprocates the core pin 26. The cylinder block 46 is shaped into a cylindrical form having closed ends, and a piston side portion of the core pin 26 is coaxially received in the cylinder block 46. With this arrangement, the piston 28 can axially reciprocate in the cylinder block 46 while an outer peripheral edge of the piston 28 is slidably engaged with an inner peripheral wall of the cylinder block 46. As shown in FIG. 3A, when the core pin 26 reaches the insertable limit position, the first pressure receiving portion 31 is engaged with a first engaging wall 47 located at one end of the cylinder block 46. On the other hand, as shown in FIG. 3B, when the core pin 26 reaches the retractable limit position, the second pressure receiving portion 32 is engaged with a second engaging wall 48 located at the other end of the cylinder block 46.

As shown in FIG. 1, when the core pin 26 is placed between the insertable limit position and the retractable limit position, the inner space of the cylinder block 46 is partitioned into two spaces by the piston 28. In this way, the cylinder block 46 forms a first fluid chamber 49 in one of the partitioned spaces, which faces the first pressure receiving portion 31, and a second fluid chamber 50 in the other one of the partitioned spaces, which faces the second pressure receiving portion 32. The first flow passage 38 is communicated with the first fluid chamber 49. The working fluid, which is supplied from the first flow passage 38 to the first fluid chamber 49, applies hydraulic pressure to the first pressure receiving portion 31 in the retracting direction Y. The second flow passage 39 is communicated with the second fluid chamber 50. The working fluid, which is supplied from the second flow passage 39 to the second fluid chamber 50, applies hydraulic pressure to the second pressure receiving portion 32 in the inserting direction X.

The hydraulic pump 52 takes working fluid from an oil pan 53 and discharges the working fluid into the third flow passage 42. The oil pan 53 also serves as a drain for draining working fluid from the fourth flow passage 43.

The solenoid valve 54 is a four port valve and is electrically connected to the control unit 58. When the solenoid valve 54 drives a spool (not shown) received therein from a neutral position toward one side based on a corresponding command signal received from the control unit 58, the first flow passage 38 is communicated with the fourth flow passage 43, and the second flow passage 39 is communicated with the third flow passage 42. On the other hand, when the solenoid valve 54 drives the spool from the neutral position toward the other side based on a corresponding command signal received from the control unit 58, the first flow passage 38 is communicated with the third flow passage 42, and the second flow passage 39 is communicated with the fourth flow passage 43.

The first pressure sensor 55 is arranged between the cylinder block 46 and the branched pipes in the connecting pipe line 34 and measures hydraulic pressure of the first fluid chamber 49 conducted to the first flow passage 38. The second pressure sensor 56 is arranged between the cylinder block 46 and the branched pipes in the connecting pipe line 35 and measures hydraulic pressure of the second fluid chamber 50 conducted to the second flow passage 39. Each pressure sensor 55, 56 is electrically connected to the control unit 58 and transmits a signal indicating the measured hydraulic pressure to the control unit 58.

The control unit 58 includes an electronic circuit and computes hydraulic pressure of each fluid chamber 49, 50 based on the measurement signal received from each pressure sensor 55, 56. The control unit 58 generates a command signal of the solenoid valve 54 based on the computed hydraulic pressure of each fluid chamber 49, 50 and transmits the generated command signal to the solenoid valve 54. The solenoid valve 54 is operated based on the received command signal, so that "the transmission of the command signal from the control unit 58 to the solenoid valve 54" will be hereinafter referred to as "control of the solenoid valve 54 by the control unit 58" for the sake of convenience.

The control unit 58 further includes a monitor 59 and controls a display of the monitor 59 based on the computed hydraulic pressure of each fluid chamber 49, 50.

Figure 5:
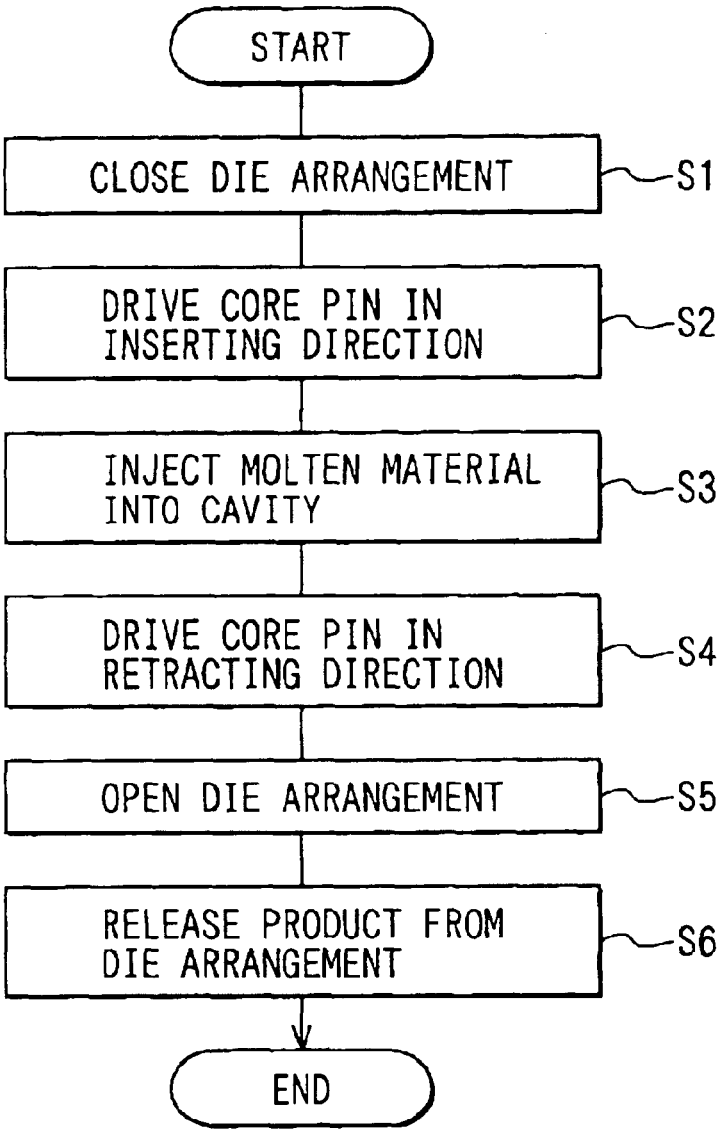
FIG. 5 is a flow chart for describing sleeve molding operation of the manufacturing apparatus shown in FIG. 1.

The structure of the manufacturing apparatus 10 have been described. Die-casting operation of the sleeve 1 with use of the manufacturing apparatus 10, i.e., a manufacturing method of the sleeve 1 with use of the manufacturing apparatus 10 according to the embodiment will be described with reference to steps S1-S6 of FIG. 5.

At step S1, the die closure arrangement 15 is operated to drive the movable die 13 toward the stationary die 12 and thereby to close the die arrangement 11.

At step S2, the core pin 26 is driven in the inserting direction X to insert the rod 27 into the cavity 19 of the die arrangement 11 through the cavity inserts 14*a*–14*e*.

Figure 6A:
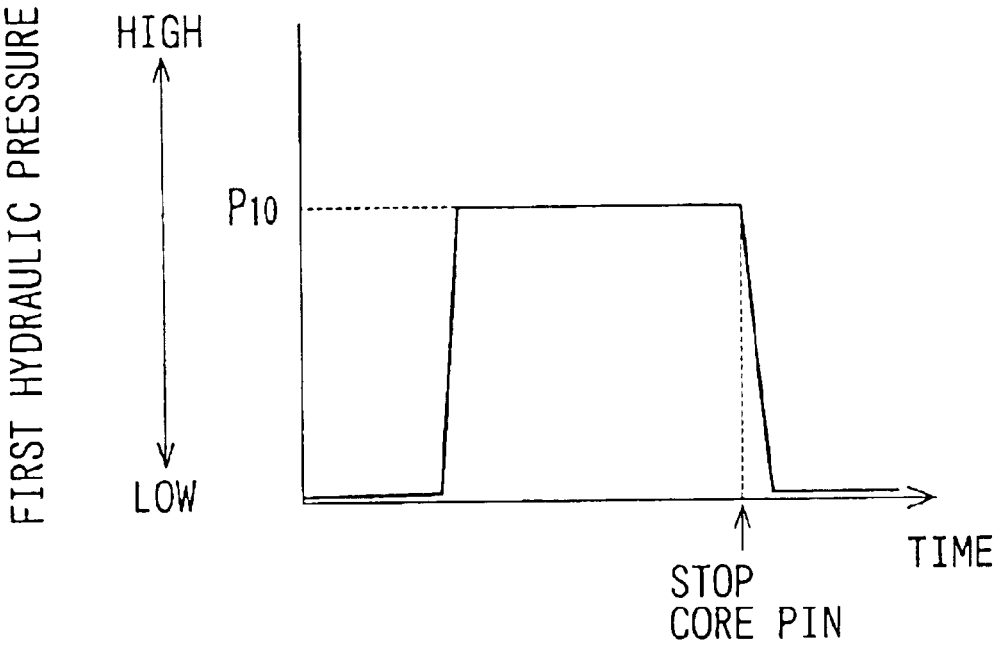
FIG. 6A is a characteristic diagram for describing abnormality monitoring operation of the manufacturing apparatus shown in FIG. 1 during a normal period.

Specifically, the solenoid valve 54 is controlled by the control unit 58, so that the first flow passage 38 is communicated with the fourth flow passage 43, and the second flow passage 39 is communicated with the third flow passage 42. Thus, the hydraulic pressure (hereinafter, referred to as a first hydraulic pressure) of the first fluid chamber 49 is shifted to a drain pressure, which is lower than the discharge pressure of the hydraulic pump 52, and the hydraulic pressure (hereinafter, referred to as a second hydraulic pressure) of the second fluid chamber 50 coincides with the discharge pressure of the hydraulic pump 52. Therefore, a resultant force $F_1$, which is a sum of the force generated by the first hydraulic pressure received by the first receiving portion 31 and the force generated by the second hydraulic pressure received by the second pressure receiving portion 32, acts as a force exerted in the inserting direction X, so that the core pin 26 initiates movement in the inserting direction X. At this time, the core pin 26 pushes working fluid through the first pressure receiving portion 31 to drive the working fluid out of the first fluid chamber 49 into the first flow passage 38, so that the first hydraulic pressure of the first fluid chamber 49 is increased as the back pressure, as shown in FIG. 6A. In the present embodiment, the flow rate of working fluid in the first flow passage 38 is adjusted through the flow rate control valve 40, so that the first hydraulic pressure is increased to a predetermined pressure $P_{10}$ and is thereafter maintained at that pressure, as shown in FIG. 6A. The maintaining pressure $P_{10}$ is set such that the maintaining pressure $P_{10}$ does not prevent the movement of the core pin 26 in the inserting direction X of the core pin 26.

The core pin 26, which is driven in the inserting direction X, is stopped at the insertable limit position through the engagement between the first pressure receiving portion 31 and the first engaging wall 47 of the cylinder block 46. When the core pin 26 is stopped at the insertable limit position, the first hydraulic pressure is returned to the drain pressure, and the second hydraulic pressure is maintained at the discharge pressure of the hydraulic pump 52, as shown in FIG. 6A. In this way, retraction of the core pin 26 from the cavity 19 is prevented when the core pin 26 receives the injecting pressure of the molten material at the following step S3.

At step S3, while the clamping pressure is applied to the stationary die 12 and the movable die 13 from the die closure arrangement 15, the molten material is injected from the injecting arrangement 22 into the cavity 19 of the die arrangement 11. At this time, the injecting pressure is set to a relatively low pressure to restrain inclusion of air bubbles into the molten material, and then the injecting pressure is increased to a relatively high pressure to fill the molten material throughout the cavity 19. Here, it should be noted that although next step S4 can be initiated after completion of solidification of the entire molten material filled in the cavity 19, next step S4 is actually initiated upon solidification of only a contacting surface layer of the molten material, which contacts the core pin 26, in this embodiment. In this way, tight engagement of the sleeve 1 to the core pin 26, which is caused by solidification and shrinkage of the molten material, can be alleviated. Thus, in the present embodiment, the solidification of the molten material means solidification of at least part of the molten material.

At step S4, the core pin 26 is driven in the retracting direction Y to retract the rod 27 from the cavity inserts 14*a*–14*e* of the die arrangement 11 and the through hole 20.

Figure 7A:
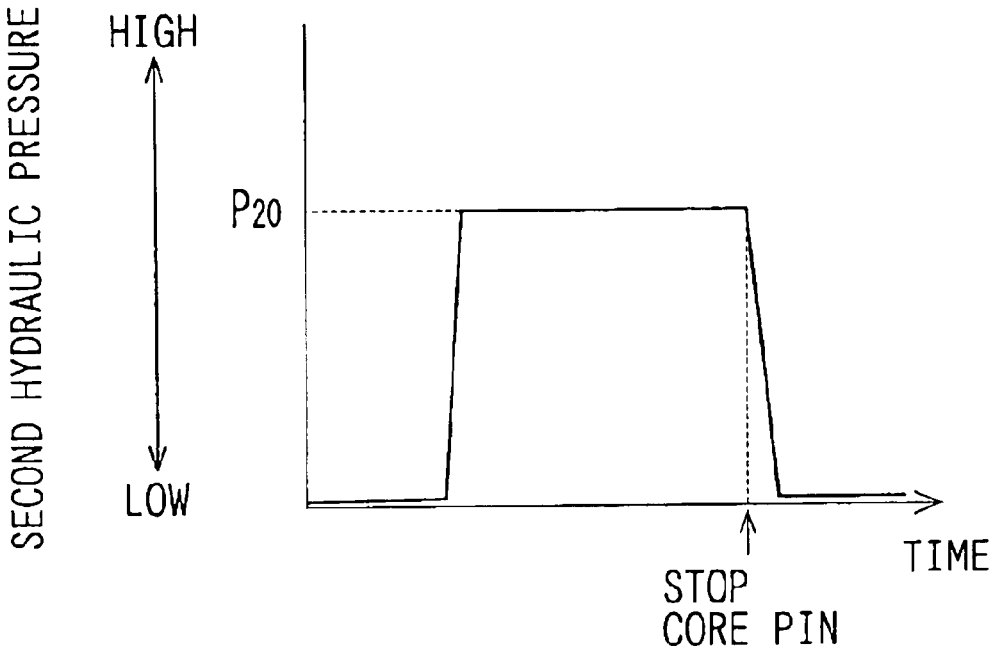
FIG. 7A is another characteristic diagram for describing abnormality monitoring operation of the manufacturing apparatus shown in FIG. 1 during a normal period.

Specifically, the solenoid valve 54 is controlled by the control unit 58, so that the first flow passage 38 is communicated with the third flow passage 42, and the second flow passage 39 is communicated with the fourth flow passage 43. Thus, the first hydraulic pressure of the first fluid chamber 49 coincides with the discharge pressure of the hydraulic pump 52, and the second hydraulic pressure of the second fluid chamber 50 is shifted to the drain pressure, which is lower than the discharge pressure of the hydraulic pump 52. Therefore, a resultant force $F_2$, which is a sum of the force generated by the first hydraulic pressure received by the first receiving portion 31 and the force generated by the second hydraulic pressure received by the second pressure receiving portion 32, acts as a force exerted in the retracting direction Y, so that the core pin 26 initiates movement in the retracting direction Y. At this time, the core pin 26 pushes working fluid through the second pressure receiving portion 32 to drive the working fluid out of the second fluid chamber 50 into the second flow passage 39, so that the second hydraulic pressure of the second fluid chamber 50 is increased as the back pressure, as shown in FIG. 7A. In the present embodiment, the flow rate of working fluid in the second flow passage 39 is adjusted through the flow rate control valve 40, so that the second hydraulic pressure is increased to a predetermined pressure $P_{20}$ and is thereafter maintained at that pressure, as shown in FIG. 7A. The maintaining pressure $P_{20}$ is set such that the maintaining pressure $P_{20}$ does not prevent the movement of the core pin 26 in the retracting direction Y of the core pin 26.

The core pin 26, which is driven in the retracting direction Y, is stopped at the retractable limit position through the engagement between the second pressure receiving portion 32 and the second engaging wall 48 of the cylinder block 46.

At step S5, the clamping force applied from the die closure arrangement 15 is released, and the movable die 13 is driven in a direction away from the stationary die 12 to open the die arrangement 11.

At step S6, the die-cast sleeve 1 is pushed by the ejector pin 18 to release the sleeve 1 from the movable die 13. The thus manufactured sleeve 1 includes the cast hole 2 formed by the core pin 26, the grooves 4*a*–4*e* formed by the cavity inserts 14*a*–14*e*, and the through holes 5*a*–5*e* formed by the stationary die 12 or the movable die 13.

The die-casting operation of the sleeve with use of the manufacturing apparatus 10 has been described. Abnormality monitoring operation of the manufacturing apparatus 10, i.e., a monitoring method for monitoring abnormality during manufacturing of the sleeve 1 according to the embodiment of the present invention will be described.

Figure 6B:
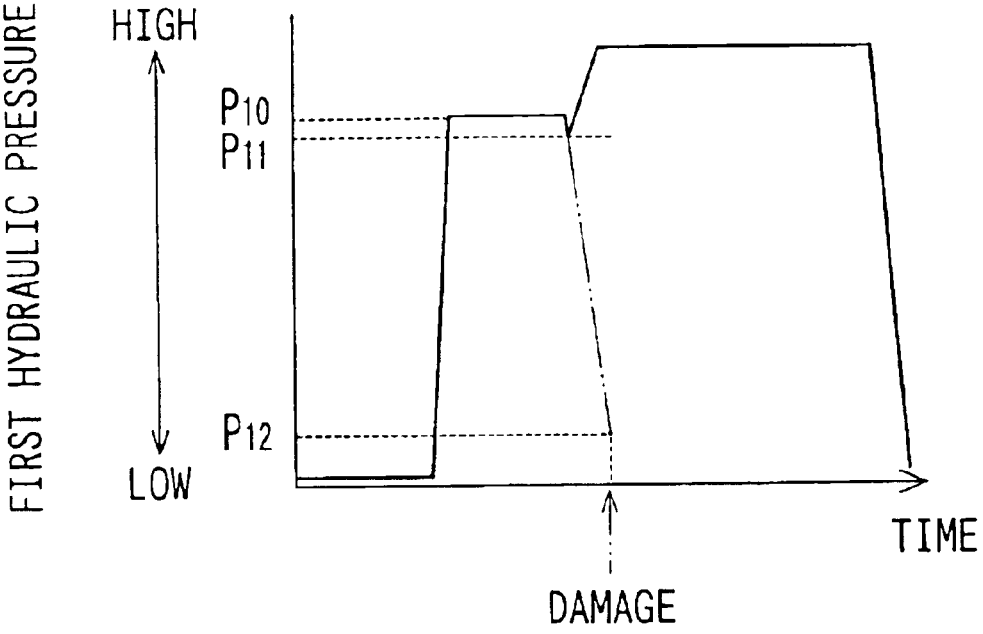
FIG. 6B is a characteristic diagram for describing abnormality operation of the manufacturing apparatus shown in FIG. 1 during an abnormal period.

In the manufacturing apparatus 10, at step S2, while the core pin 26 is driven in the inserting direction X, the first hydraulic pressure, which now acts as the back pressure, of the first fluid chamber 49 is measured and is monitored through the first pressure sensor 55. When the core pin 26 does not collide with the cavity inserts 14*a*–14*e* during the movement of the core pin 26 in the inserting direction X, the first pressure is increased and is maintained at the maintaining pressure $P_{10}$. On the other hand, when the core pin 26 collides with any of the cavity inserts 14*a*–14*e*, the core pin 26 receives resistive force from the cavity insert 14*a*–14*e* in a counter direction, which causes limitation of the movement of the core pin 26 in the inserting direction X, so that the core pin 26 is stopped. Thus, the first hydraulic pressure is reduced below the maintaining pressure $P_{10}$, as shown in FIG. 6B. At this time, the second hydraulic pressure coincides with the discharge pressure of the hydraulic pump 52, so that the resultant force $F_1$, which is a sum of the force generated by the first hydraulic pressure and the force generated by the second hydraulic pressure, is increased due to the reduction in the first hydraulic pressure. Therefore, when no countermeasure is taken against this, the first hydraulic pressure is reduced to a destructive critical pressure $P_{12}$, as indicated by a dot-dot-dash line in FIG. 6B, so that damage of the cavity inserts 14*a*–14*e* will occur. However, in the manufacturing apparatus 10, when the first hydraulic pressure reaches a threshold pressure $P_{11}$, which is set to be higher than the destructive critical pressure $P_{12}$, the solenoid valve 54 is controlled by the control unit 58, so that the first flow passage 38 and the second flow passage 39 are communicated with the third flow passage 42 and the fourth flow passage 43, respectively. As a result, as shown in FIG. 6B, the first hydraulic pressure is increased, and the second hydraulic pressure is reduced. Therefore, the movement of the core pin 26 in the inserting direction X is stopped, and the core pin 26 is then driven in the retracting direction Y. In this way, damage of the cavity inserts 14*a*–14*e* is effectively prevented.

Figure 7B:
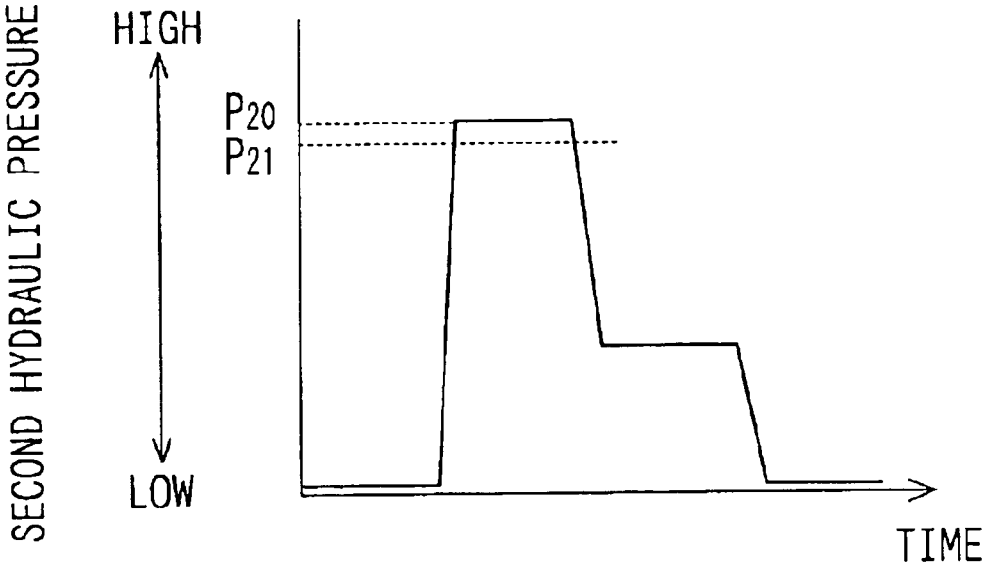
FIG. 7B is another characteristic diagram for describing abnormality monitoring operation of the manufacturing apparatus shown in FIG. 1 during an abnormal period.

Furthermore, in the manufacturing apparatus 10, at step S4, while the core pin 26 is driven in the retracting direction Y, the second hydraulic pressure, which now acts as a back pressure, of the second fluid chamber 50 is measured and is monitored through the second pressure sensor 56. When the die-cast sleeve 1 is not tightly engaged with the core pin 26, the second hydraulic pressure is increased and is held at the maintaining pressure $P_{20}$, as described above. On the other hand, when the sleeve 1 is tightly engaged with the core pin 26 due to, for example, the solidification and shrinkage of the molten material or galling of the material, the core pin 26 receives resistive force from the sleeve 1 in a counter direction, which causes limitation of the movement of the core pin 26 in the retracting direction Y, so that second hydraulic pressure is reduced below the maintaining pressure $P_{20}$, as shown in FIG. 7B. In the manufacturing apparatus 10, when the second hydraulic pressure is reduced and is reached to a threshold pressure $P_{21}$, as shown in FIG. 7B, the controlled state of the solenoid valve 54 is maintained by the control unit 58 to continuously drive the core pin 26 in the retracting direction, and a warning message (notification) is indicated on the monitor 59 to notify the occurrence of the tight engagement between the sleeve 1 and the core pin 26. Because of the notification, an operator of the apparatus 10 can notice the occurrence of the tight engagement between the core pin 26 and the sleeve 1 in advance to the release of the sleeve 1 from the die arrangement performed at step S6. The sleeve 1, which is tightly engaged with the core pin 26, may have a defect, such as, galling, of the sleeve 1 when the core pin 26 is forcefully pulled out of the sleeve 1. However, the operator, who can notice the occurrence of the tight engagement of the sleeve 1 and the defect caused by the tight engagement in advance, can dispose or discard such a defective sleeve 1 without inspecting it after release of the sleeve 1 from the die arrangement 11.

As described above, according to the present embodiment, the first hydraulic pressure and the second hydraulic pressure correspond to the first hydraulic pressure and the second fluid pressure, respectively, and the threshold pressure $P_{11}$ and the threshold pressure $P_{21}$ correspond to a fixed threshold value of the first fluid pressure and a fixed threshold value of the second fluid pressure, respectively. In the present embodiment, the cylinder block 46, the solenoid valve 54, the hydraulic pump 52 and the connecting pipe lines 34–37 cooperate together to form a driving means for reciprocably driving the core pin 26 through adjustment of the hydraulic pressure of each fluid chambers 49, 50. In the present embodiment, the first pressure sensor 55, the second pressure sensor 56 and the control unit 58 cooperate together to form a monitoring means for monitoring the hydraulic pressure of each fluid chamber 49, 50 or information that relates to the hydraulic pressure of each fluid chamber 49, 50 and for controlling the driving means.

With use of the manufacturing apparatus 10 described above, damage of the cavity inserts 14*a*–14*e* can be effectively prevented at the time of driving the core pin 26 in the inserting direction X, and the sleeve 1, which has the defect generated at the time of driving the core pin 26 in the retracting direction Y, can be disposed without inspecting it. Thus, the productivity of the die-cast product can be improved.

Furthermore, in the manufacturing apparatus 10, the first hydraulic pressure, which becomes the back pressure at the time of driving the core pin 26 in the inserting direction X, shows a reduction from the constant pressure $P_{10}$ as abnormal behavior (or abnormal change), which is different from normal behavior (or normal change) observed during the normal operation, at the time of collision of the core pin 26 with the cavity insert 14*a*–14*e*. In addition, in the manufacturing apparatus 10, the second hydraulic pressure, which becomes the back pressure at the time of driving the core pin 26 in the retracting direction Y, shows a reduction from the constant pressure $P_{20}$ as abnormal behavior (or abnormal change), which is different from normal behavior (or normal change) observed during the normal operation, at the time of occurrence of the tight engagement between the core pin 26 and the sleeve 1. Such a reduction of the hydraulic pressure from the corresponding constant pressure $P_{10}$, $P_{20}$ can be easily detected through the pressure sensors 55, 56. Thus, the monitoring accuracy of the first hydraulic pressure and the second hydraulic pressure can be improved.

Also, in the manufacturing apparatus 10, the draft angle θ of the core pin 26 is set to the small value of 0–30 degrees to reduce the amount of cut required in the cutting operation performed after the die-casting operation. In such a setting of the draft angle, there is an increased possibility of collision of the core pin 26 with the cavity inserts 14*a*–14*e*. However, with use of the manufacturing apparatus 10, the collision of the core pin 26 with the cavity inserts 14*a*–14*e* can be notified based on the monitored hydraulic pressure of the first fluid chamber 49. Thus, damage of the cavity inserts 14*a*–14*e* caused by the collision can be prevented regardless of the excessively small draft angle θ of the core pin 26.

In the above embodiment, the first fluid chamber 49 and the second fluid chamber 50 are formed in the single cylinder block 46. Alternatively, for example, two pistons can be provided in the core pin 26. In such a case, the first fluid chamber can be formed by one cylinder block, which receives one of the pistons, and the second fluid chamber can be formed by another cylinder block, which receives the other one of the pistons.

Furthermore, in the above embodiment, the first hydraulic pressure, which serves as the first fluid pressure, is monitored at the time of driving the core pin 26 in the inserting direction, and the second hydraulic pressure, which serves as the second fluid pressure, is monitored at the time of driving the core pin 26 in the retracting direction. Alternatively, the monitoring of one of the first hydraulic pressure and the second hydraulic pressure can be omitted.

Furthermore, in the above embodiment, when the second hydraulic pressure is dropped to the threshold pressure $P_{21}$, which serves as the fixed threshold value, the occurrence of such a pressure drop is notified to the operator. Alternatively, when the occurrence of drop of the second hydraulic pressure to the threshold pressure $P_{21}$ is detected, the sleeve 1, which is the die-cast product released from the die arrangement, can be automatically disposed by, for example, a robot machine. In this way, the productivity of the sleeve 1 can be further improved.

Furthermore, in the above embodiment, the present invention is embodied in the manufacturing apparatus 10 and the manufacturing method for manufacturing the sleeve 1 of the solenoid valve, which serves as the die-cast product. Alternatively, the present invention can be applied to manufacturing of various die-cast products manufactured through die-casting.

Additional advantages and modifications will readily occur to those skilled in the art. The invention in its broader terms is therefore, not limited to the specific details, representative apparatus, and illustrative examples shown and described.

What is claimed is:

1. A method for manufacturing a die-cast product, which includes a cast hole, the method comprising:

driving a core pin in an inserting direction until the core pin reaches an insertable limit position to insert the core pin into a cavity of a die arrangement by supplying working fluid into a second fluid chamber of a driving means while draining working fluid from a first fluid chamber of the driving means, wherein the driving of the core pin in the inserting direction includes monitoring a fluid pressure of the first fluid chamber, which acts as a back pressure, during the driving of the core pin in the inserting direction, and the monitoring of the fluid pressure of the first fluid chamber includes stopping of the core pin when the monitored fluid pressure of the first fluid chamber exhibits abnormal behavior that is different from normal behavior exhibited in a normal operation;

injecting a molten material from an injecting means into the cavity;

solidifying the molten material received in the cavity to form the die-cast product;

driving the core pin in a retracting direction until the core pin reaches a retractable limit position to remove the core pin from the cavity; and removing the die-cast product from the cavity.

2. The method according to claim 1, wherein the driving of the core pin in the inserting direction further includes maintaining the fluid pressure of the first fluid chamber at a predetermined value by forcing working fluid out of the first fluid chamber through use of the core pin during the driving of the core pin in the inserting direction.

3. The method according to claim 1, wherein the monitoring of the fluid pressure of the first fluid chamber further includes driving the core pin in the retracting direction when the monitored fluid pressure of the first fluid chamber is dropped to a fixed threshold value set for the first fluid chamber.

4. The method according to claim 1, wherein the driving of the core pin in the retracting direction includes monitoring a fluid pressure of the second fluid chamber, which acts as a back pressure, during the driving of the core pin in the retracting direction.

5. The method according to claim 4, wherein the driving of the core pin in the retracting direction further includes maintaining the fluid pressure of the second fluid chamber at a predetermined value by forcing working fluid out of the second fluid chamber through use of the core pin during the driving of the core pin in the retracting direction.

6. The method according to claim 5, wherein the monitoring of the fluid pressure of the second fluid chamber includes outputting a notification and keeping the driving of the core pin in the retracting direction when the monitored fluid pressure of the second fluid chamber is dropped to a fixed threshold value set for the second fluid chamber.

7. The method according to claim 1, wherein a draft angle of the core pin is in a range of 0 to 30 degrees.

* * * * *